United States Patent [19]

Branson et al.

[11] Patent Number: 4,971,454

[45] Date of Patent: Nov. 20, 1990

[54] RECLOSABLE BAG HAVING A TOP CLOSURE ATTACHED TO A BAG BODY COMPOSED OF MULTIPLE THERMOPLASTIC LAYERS

[75] Inventors: Mark E. Branson, Shelbyville; Paul F. Edelman, Greenwood, both of Ind.

[73] Assignee: KCL Corporation, Shelbyville, Ind.

[21] Appl. No.: 438,092

[22] Filed: Nov. 16, 1989

[51] Int. Cl.[5] ..... B65D 30/08; B65D 33/16; B65D 33/34

[52] U.S. Cl. ..... 383/61; 383/5; 383/63; 383/78; 383/81; 383/109; 383/116; 206/610; 493/214

[58] Field of Search ..... 383/5, 61, 63, 78, 79, 383/81, 109, 113, 116; 206/610; 493/214; 156/66

[56] References Cited

U.S. PATENT DOCUMENTS

| | | | |
|---|---|---|---|
| 3,085,738 | 4/1963 | Bok | 383/81 X |
| 3,181,583 | 5/1965 | Lingenfelter | 383/61 X |
| 3,226,787 | 1/1966 | Ausnit | 383/61 X |
| 3,473,589 | 10/1969 | Götz | 383/61 X |
| 3,473,725 | 10/1969 | Wiehahn | 383/78 |
| 3,746,215 | 7/1973 | Ausnit et al. | 383/61 X |
| 3,827,472 | 8/1974 | Uramoto | 383/61 X |
| 3,839,128 | 10/1974 | Arai | 493/214 X |
| 3,939,972 | 2/1976 | Mayworm | 383/113 X |
| 3,948,705 | 4/1976 | Ausnit | 493/214 X |
| 3,958,749 | 5/1976 | Goodrich | 383/113 X |
| 3,991,801 | 11/1976 | Ausnit | 383/61 |
| 4,094,729 | 6/1978 | Boccia | 493/214 X |
| 4,191,230 | 3/1980 | Ausnit | 383/61 |
| 4,231,865 | 12/1980 | Ferrell | 210/636 |
| 4,285,376 | 8/1981 | Ausnit | 383/61 |
| 4,617,683 | 10/1986 | Christoff | 493/214 X |
| 4,637,063 | 1/1987 | Sullivan et al. | 383/61 |
| 4,691,372 | 9/1987 | Van Erden | 383/63 |
| 4,703,518 | 10/1987 | Ausnit | 383/63 |
| 4,756,629 | 7/1988 | Tilman et al. | 383/63 |

*Primary Examiner*—Stephen Marcus
*Assistant Examiner*—Jes F. Pascua
*Attorney, Agent, or Firm*—Woodard, Emhardt, Naughton Moriarty & McNett

[57] ABSTRACT

A bag structure includes a tubular bag body closed at one end and at its edges but open at the bag top. A top closure is affixed to the bag body covering the bag top. The bag body includes opposite wall panels which include a opposite outer layers and opposite inner layers, in which the outer layers are formed from a material that is more readily fusible than the material of the inner layers. The top closure includes opposite attachment flanges composed of a material that is more readily fusible to the outer layer than the inner layer. In one specific embodiment, a heated pressure bar is applied to heat seal the attachment flanges of the top closure to the outer layers of the bag body, while the inner layers of the wall panels remain intact and are not fused together. The inner layer material has a fusion temperature higher than the temperature at which the outer layers and top closure attachment flanges fuse.

10 Claims, 2 Drawing Sheets

RECLOSABLE BAG HAVING A TOP CLOSURE ATTACHED TO A BAG BODY COMPOSED OF MULTIPLE THERMOPLASTIC LAYERS

BACKGROUND OF THE INVENTION

The present invention relates to the art of reclosable sacks or bags of fusible material, and is more particularly concerned with an improved reclosable bag having a separate top closure that is affixed to a tubular bag body.

Reclosable bags and thermoplastic material are well known in the art. For instance, the patent to Sullivan, et al., U.S. Pat. No. 4,637,063, assigned to the Assignee of the present invention, describes a bag structure having a primary and secondary closure for access to the contents within the bag. The primary closure is non-reclosable, while the secondary closure comprises a reclosable fastener zipper for selectively opening and closing the bag top opening. The Sullivan reference describes a bag structure having an inner thermoplastic liner which is heat-sealed at the inner surface to form the primary closure. The bag structure includes an outer body that is composed of a paper material.

A similar multi-layer bag is shown in the Goodrich patent, U.S. Pat. No. 3,958,749. The Goodrich bag includes an inner bag of a fusible material enclosed within an outer bag of a multi-layer paper or other non-fusible material.

Several bag structures in the art have combined a primary non-reclosable closure with a secondary reclosable closure. The primary non-reclosable closure provides a tamper-evident or security feature to the bag, while the reclosable closure provides means to selectively open and close the bag when the primary closure is removed. In one approach, as embodied in the patent to Ferrell, U.S. Pat. No. 4,241,865, owned by the present Assignee, a reclosable shipping sack is disclosed having an outboard reclosable fastener and an inboard stitched fastener. However, the sewn closure inboard of the reclosable closure is undesirable in applications which require that the bag be moisture-proof. The perforations left by the stitched fastener permit leakage through the bag wall. Another problem, particularly with thermoplastic bag walls, is a tendency to tear along the perforations left by the stitched fastener.

In order to avoid the problem of inboard stitched fasteners, the non-reclosable closure has been positioned outboard the reclosable closure. In this instance, the top closure includes some portion that is affixed to the outer wall of the tubular bag body. When the closure is formed from a thermoplastic material, the primary and secondary closures are frequently integrally formed in a single extrusion process. The use of heated pressure bars to seal the thermoplastic closure to the bag body is well known in the art. It is frequently desirable to adhere the top closure to the outer surface of the thermoplastic bag body without likewise adhering the inner surfaces of the mouth of the body together. In the past, a heat-resistant plate has been situated between the inner layers while the heated pressure bars are applied to the top closure and bag outer surface. One example is shown in the patent to Arai, U.S. Pat. No. 3,839,128, which discloses an apparatus for manufacturing containers from thermoplastic film in which a stationary guide is placed between inner layers of thermoplastic film that are not intended to be heat-sealed together.

No prior art reference is known to applicant in which a thermoplastic top closure is heat-sealed to the outer wall of a thermoplastic bag body in which the inner wall of the bag body is not similarly heat sealed. Present bag structures avoid this type of fusible construction entirely or employ a heat resistant plate between inner surfaces to keep the top opening of the bag body from being inadvertently closed when the top closure is attached.

SUMMARY OF THE INVENTION

It is an object of the present invention to provide a multi-layer thermoplastic bag structure that permits heat sealing of a top closure to the outside of the bag body but does not permit heat sealing of the inner surfaces of the thermoplastic material together. It is another object to provide a multi-layer bag structure that is a capable of carrying a wide variety of top closure configurations, including top closures having primary non-reclosable and secondary reclosable closure means.

These and other objects are achieved in a bag structure composed of a tubular bag body formed from multi-layer wall panels. The tubular bag body is closed at one end and at its edges but open at the bag top. A top closure is affixed covering the bag top. The wall panels include an outer layer and an inner layer, in which the outer layer is more readily fusible than the inner layer. Thus, in one embodiment, when a heated pressure bar is applied to heat seal the top closure to the outer layer of the bag body, the inner layers of the wall panels remain intact and are not fused together.

Other objects and benefits of the present invention will become apparent from the following disclosure and accompanying figures.

DESCRIPTION OF THE PREFERRED EMBODIMENTS

Figure 1A:
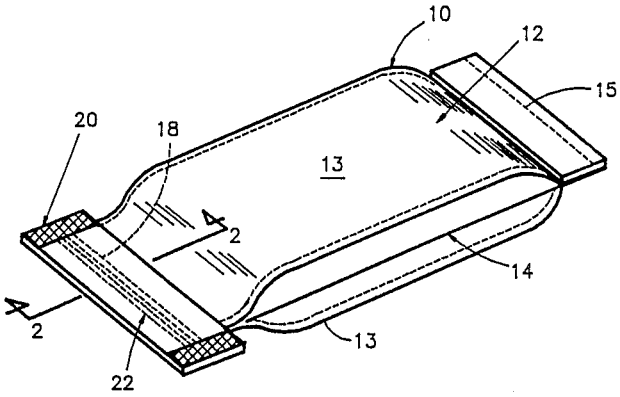
FIG. 1A is a perspective view of a bag embodying the invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1A, a gussetted bag structure 10 is shown which comprises a tubular bag body 12. The tubular bag body 12 includes opposite wall panels 13 joined at the sides by gussets 14. The wall panels 13 are sealed at the bottom end 15 by conventional means, such as is shown in the Sullivan, et al. patent, U.S. Pat. No. 4,637,063. A top closure 20 is mounted over the bag top 18 to provide means for selectively opening and closing the bag top to permit access to the contents of the bag structure 10.

Figure 1B:
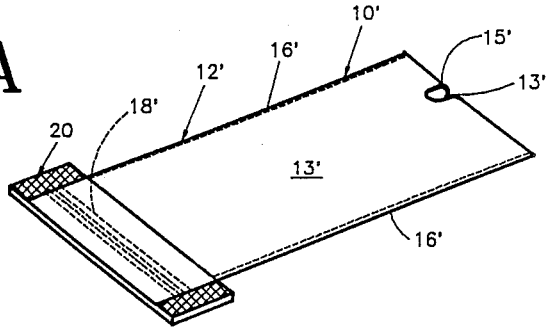
FIG. 1B is a perspective view of a second embodiment of the bag incorporating the present invention.

An alternative configuration of the bag structure is a flat bag structure 10', as shown in FIG. 1B, which includes a tubular bag body 12' formed from a pair of opposite wall panels 13'. In this bag structure 10' the gussets have been removed and the edges 16' of the bag body are sealed together, such as by a standard heat-sealing process. The bottom end of the bag 15' can be formed by folding the wall panels 13' on top of each other. The bag structure 10' includes a top closure, such as top closure 20, mounted over the bag top 18' in a manner similar to the gusseted bag structure 10.

In one embodiment, the top closure 20 includes opposing interlocking profiles 22 which are integral with a hooded closure 23. The hooded closure 23 operates as a primary non-reclosable, or tamper-evident closure, for the bag structure 10. The hooded closure 23 may be severed along a tear-line (not shown) or cut in some other fashion to open the hooded closure and provide access to the contents of the bag. The interlocking profiles 22 constitute a secondary reclosable closure that can be selectively opened and closed once the hooded closure 23 has been removed. The top closure 20 in the present embodiment includes a single panel which carries the interlocking profiles 22 and is overlapped at the top to form the hooded closure 23.

Figure 2A:
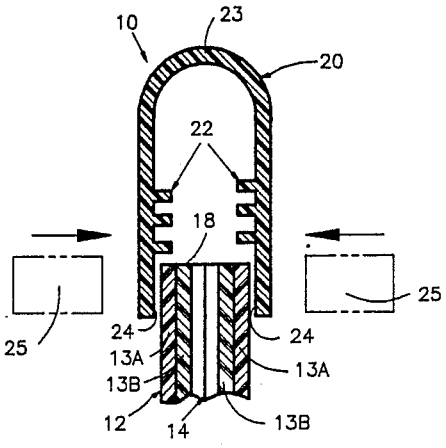
FIG. 2A is a side cross-sectional view taken along line 2—2 in FIG. 1*a* as viewed in the direction of the arrows.
Figure 2B:
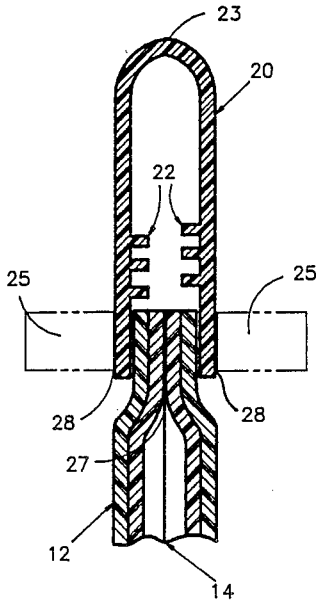
FIG. 2B is a view of the bag shown in FIG. 2*a* with the heated pressure bars compressing the bag layers together.

Referring to FIGS. 2A and 2B, the gusseted bag structure 10 is shown in cross-sectional view to more particularly illustrate the present invention and its manner of manufacture. Each of the wall panels 13 includes an outer layer 13A and an inner layer 13B. The outer and inner layers of the wall panels 13 can be co-extruded, or can be separately extruded and adhered together, to form a laminated bag as is known in the art and as is described in the Uramoto patent, U.S. Pat. No. 3,827,472. The top closure 20 includes opposite attachment flanges 24 disposed against and affixed to the outer layer 13A of the opposite wall panels 13. In the preferred embodiment, both layers of the wall panels as well as the top closure 20 are composed of a thermoplastic material or a thermoplastic synthetic resin, such as polyvinylchloride, polyvinylacetate, polyethylene, vinyl resin or an ethylene monomer copolymer.

In an important aspect of the invention, the outer layer 13A of the wall panels 13 is of a material that is more readily fusible than the inner layer. The top closure 22, and particularly the attachment flanges 24, is also composed of a material having similar properties to the outer layer 13A of the wall panels. In the illustrated embodiment, a pair of heated pressure bars 25 are used to attach the top closure attachment flanges 24 to the outer layers 13A, using a combination of heat and pressure to fuse the material of the respective components together. Thus, in this embodiment, the inner layer 13B has a fusion temperature higher than the temperature at which the outer layer 13A will fuse when subject to heat and pressure. When the wall panels 13 and attachment flanges 24 are subject to heat and pressure from the heated pressure bars 25 the material of the outer layers 13A and attachment flanges 24 will melt or fuse together at a lower temperature than the material of the inner layer 13B. In the preferred embodiment, the outer layer is composed of a low density thermoplastic, while the inner layer 13B is composed of a high density thermoplastic.

As shown in FIG. 2B, the heated pressure bars 25 are moved inward to depress the top closure and the tubular bag body 12 therebetween at the bag top 18. The heated pressure bars typically produce a temperature of between 80° and 200° F. At this temperature, the attachment flanges 24 is heat-sealed at an outer layer seal 28 to the the outer layer 13A. However, the temperature produced by the heated pressure bars 25 is not sufficiently high to melt the inner layer 13B at the joint 27 between the two inner layers. Once the top closure 20 has been fused to the outer layer 13A at the bag top 18, the heated pressure bars 25 are retracted. The inner layers 13B of the opposite wall panels are not fused or adhered so that the bag top 18 remains open. However, the top closure 20 affixed to the bag body, and particularly the hooded closure 23, encloses the bag top.

Figure 3:
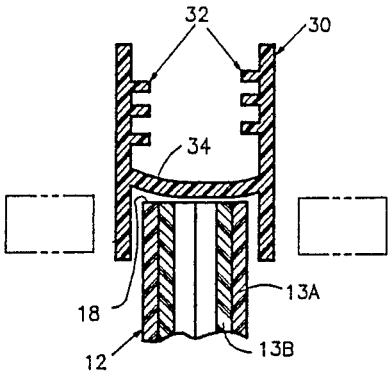
FIG. 3 is a side cross-sectional view of a bag structure embodying the present invention with an alternative configuration for the top closure of the bag.

In another embodiment of the present invention, as shown in FIG. 3, a top closure 30 is mounted over the tubular bag body 12 in a manner previously described. The bag body 12 includes outer and inner layers 13A and 13B identical to the bag shown in FIG. 2A. The top closure 30 includes outboard interlocking profiles 32 and an inboard tamper-evident panel 34. The top closure 30 may be formed in an extrusion process in which the profiles and panel 34 are integral. The tamper-evident panel 34 must be broken in order to provide access to the contents of the bag through the bag top 18.

Figure 4:
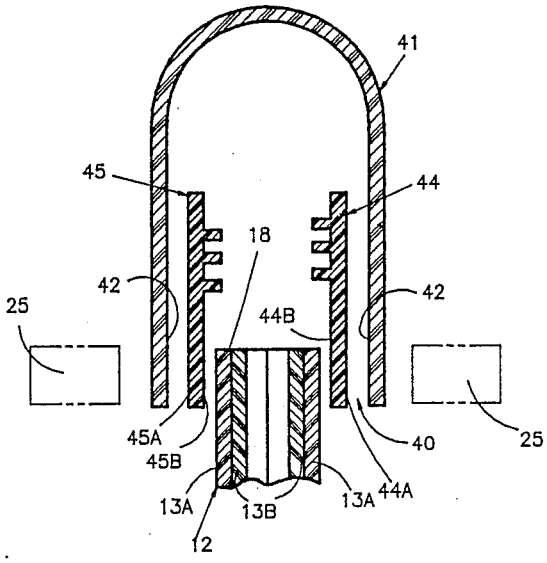
FIG. 4 is a side cross-sectional view of a bag structure embodying the present invention with an alternative configuration for the top closure of the bag.

Referring to FIG. 4, yet another embodiment of the invention is shown in which a top closure 40 includes an outer hood 41 and a pair of profile strips 44 and 45. The outer hood 41 is formed from a U-shaped thermoplastic panel which has the same fusible properties as the outer layer 13A of the wall panels of the tubular bag body 12, and as the profile strips 44 and 45. The outer hood 41 includes opposite inner surfaces 42, while the profile strips include outer surfaces 44A and 45B, respectively, against which the outer hood inner surfaces 42 are disposed. The profile strip inner surfaces 44B and 45B are disposed against the outer layer 13A. The heated pressure bars 25 are used to fuse the outer hood, the profile strips, and the outer layer 13A in a heat-sealed lamination. As in the former embodiments, the inner layer 13B of the wall panels is not fused or heat-sealed together.

Figure 5:
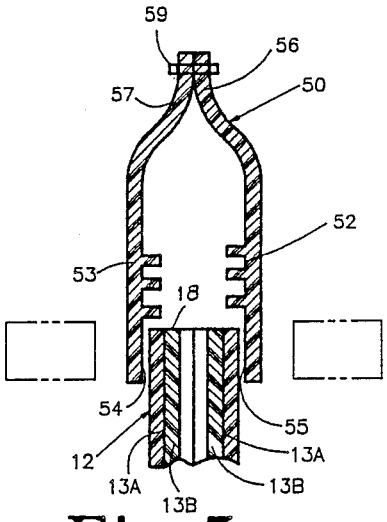
FIG. 5 is a side cross-sectional view of a bag structure embodying the present invention with an alternative configuration for the top closure of the bag.

In still another embodiment illustrated in FIG. 5, a top closure 50 mounted to a bag, such as bag 12, includes a pair of profile strips 52 and 53. Each of the profile strips includes a lower attachment flange 54 and 55, respectively, which are adapted to contact and be fused to the outer layer 13A of the wall panels 13. The profile strips 52 of the top closure 50 also includes a closure flange 56 and 57 which is above or outboard the interlocking profiles of the profile strips 52 and 53. The closure flanges 56 are adapted to be attached by way of a separate non-reclosable fastener 59. In the illustrated embodiment, the fastener is a stitched fastener which includes a thread that is stitched through both closure flanges 56 and 57. Alternatively, the closure flanges 56 and 57 can be tack-welded or fused to form a breakaway seal that can be easily opened by pulling the closure flanges 56 and 57 apart.

The present invention discloses a bag structure that is formed from a thermoplastic tubular body having inner and outer layers of different properties. The outer layer is adapted to be fused to a top closure of a similar material. The inner layer is of a material that can withstand the fusion of the outer layer without itself being fused together. Alternatively, the bag structure can include a wall panels having a coating on the outer surface that will fuse to the top closure. In this version, the top closure must be formed of a similar material as the coating on the outer layer of the wall panel.

It is also understood that other means of sealing the top closure to the bag body is contemplated. In the illustrated preferred embodiment, the bag components are heat-sealed using heated pressure bars. Alternatively, sonic welding may be employed in a manner frequently used to seal thermoplastic panels together. In this instance, the bag structure would include the inner layer which is more resistant to sonic welding than the outer layer to which the top closure is affixed.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A bag structure comprising:

a bag body having a top with an opening for access into the bag body, said bag body including;

an outer layer of a first material; and an inner layer of a second material laminated to said outer layer, wherein said first material is more readily fusible than said second material; and bag closure means carried by said top of said bag body for opening and closing said opening, said bag closure means including a lower flange portion composed of a third material readily fusible to said first material, wherein said lower flange portion is fused to said outer layer of said bag body proximate said top.

2. The bag structure of claim 1, wherein:

said first material has a fusion temperature higher than the fusion temperature of said second material.

3. The bag structure of claim 2, wherein:

said first material is a high density thermoplastic; and said second material and said third material are each a relatively low density thermoplastic.

4. The bag structure of claim 1, wherein said bag closure means includes: a removable primary closure covering said bag body opening for preventing access through said bag body opening until the primary closure is removed; and a secondary reclosable closure for selectively opening and closing said bag body opening when said primary closure is removed.

5. The bag structure of claim 4, wherein said primary closure and said secondary closure are integrally extruded.

6. The bag structure of claim 4, wherein said primary closure is between said secondary closure and said bag body opening.

7. The bag structure of claim 4, wherein said secondary closure is between said primary closure and said bag body opening.

8. The bag structure of claim 7 wherein:

said primary closure is a hooded closure; and said secondary closure includes opposing selectively interlocking profile elements.

9. The bag structure of claim 8, wherein:

each of said opposing profile elements is carried by respective opposing strips, each of said strips having an attachment flange;

said hooded closure includes a U-shaped panel separate from and overlapping said profile elements, said U-shaped panel having opposite lower attachment portions; and said lower flange portion of said bag closure means includes said attachment flange of said opposing strips and said lower attachment portions of said U-shaped panel, further wherein said attachment flange of each of said opposing strips is fused between said lower attachment portions of said U-shaped panel and said bag body outer layer.

10. The bag structure of claim 7, wherein:

said primary closure is a stitched fastener; and said secondary closure includes opposing strips, each of said strips having a lower attachment flange and an upper closure flange, wherein said lower flange portion of said bag closure means includes said lower attachment flange of each of said opposing strips, and said stitched fastener is stitched through said upper closure flanges of each of said opposing strips to join said strips and close said bag body opening.

* * * * *

UNITED STATES PATENT AND TRADEMARK OFFICE

CERTIFICATE OF CORRECTION

PATENT NO. : 4,971,454

DATED : November 20, 1990

INVENTOR(S) : Mark E. Branson and Paul F. Edelman

It is certified that error appears in the above-identified patent and that said Letters Patent is hereby corrected as shown below:

In claim 2, line 2, delete "first" and insert --second--. At line 3, delete "second" and insert --first--.

In claim 3, line 2, delete "first" and insert --second--. At line 3, delete "second" and insert --first--.

Signed and Sealed this

Second Day of July, 1991

*Attest:*

HARRY F. MANBECK, JR.

*Attesting Officer*

*Commissioner of Patents and Trademarks*